US010322440B2

(12) United States Patent
Haraguchi et al.

(10) Patent No.: US 10,322,440 B2
(45) Date of Patent: Jun. 18, 2019

(54) NOZZLE HEADER, COOLING APPARATUS, MANUFACTURING APPARATUS OF HOT-ROLLED STEEL SHEET, AND METHOD FOR MANUFACTURING HOT-ROLLED STEEL SHEET

(71) Applicant: PRIMETALS TECHNOLOGIES JAPAN, LTD., Tokyo (JP)

(72) Inventors: Yoichi Haraguchi, Tokyo (JP); Koichi Sakamoto, Tokyo (JP); Manabu Eto, Tokyo (JP); Yuji Ikemoto, Tokyo (JP); Kenji Horii, Tokyo (JP)

(73) Assignee: PRIMETALS TECHNOLOGIES JAPAN, LTD., Tokyo (JP)

( * ) Notice: Subject to any disclaimer, the term of this patent is extended or adjusted under 35 U.S.C. 154(b) by 197 days.

(21) Appl. No.: 14/426,292

(22) PCT Filed: Jun. 26, 2013

(86) PCT No.: PCT/JP2013/067470
§ 371 (c)(1),
(2) Date: Mar. 5, 2015

(87) PCT Pub. No.: WO2014/041868
PCT Pub. Date: Mar. 20, 2014

(65) Prior Publication Data

US 2015/0224551 A1 Aug. 13, 2015

(30) Foreign Application Priority Data

Sep. 12, 2012 (JP) ..... 2012-200349

(51) Int. Cl.
*B21B 45/02* (2006.01)
*B21B 3/02* (2006.01)
(Continued)

(52) U.S. Cl.
CPC ..... *B21B 3/02* (2013.01); *B05B 1/306* (2013.01); *B05B 1/3066* (2013.01); *B05B 1/32* (2013.01);
(Continued)

(58) Field of Classification Search
CPC . B21B 45/0233; B21B 45/0218; B21B 37/74; C21D 9/0062; B05B 1/3013;
(Continued)

(56) References Cited

U.S. PATENT DOCUMENTS

2003/0052199 A1* 3/2003 Ikeuchi ..... B05B 1/042 239/550
2009/0126439 A1* 5/2009 Ueoka ..... B21B 45/0218 72/201
(Continued)

FOREIGN PATENT DOCUMENTS

JP 54-181314 U 12/1979
JP 57-39660 U 3/1982
(Continued)

OTHER PUBLICATIONS

International Search Report dated Aug. 22, 2013; PCT/JP2013/067470.

*Primary Examiner* — Debra M Sullivan
(74) *Attorney, Agent, or Firm* — Ladas & Parry LLP

(57) ABSTRACT

Provided is a nozzle header which sprays pressurized water to a high-temperature object, capable of inhibiting a member provided to spray nozzles from being deformed or damaged by heat at the time of operation, caused by radiation heat from the high-temperature object. The nozzle header for spraying water to a targeted object includes a header which supplies pressurized water, one or more of spray nozzles which spray the pressurized water supplied from the header, and a heat removal structure attached so as to be in contact
(Continued)

with at least one of the spray nozzles, wherein the heat removal structure includes a coolant passage through which a cooling medium for cooling the heat removal structure itself and the spray nozzles passes.

6 Claims, 12 Drawing Sheets

(51) Int. Cl.

| | |
|---|---|
| ***B05B 1/30*** | (2006.01) |
| ***C21D 9/00*** | (2006.01) |
| ***C21D 1/60*** | (2006.01) |
| ***B05B 1/32*** | (2006.01) |
| ***C21D 8/12*** | (2006.01) |
| *C21D 8/02* | (2006.01) |

(52) U.S. Cl.
CPC ..... *B21B 45/0218* (2013.01); *B21B 45/0233* (2013.01); *C21D 1/60* (2013.01); *C21D 8/1222* (2013.01); *C21D 9/0062* (2013.01); *C21D 8/0226* (2013.01)

(58) Field of Classification Search
CPC ..... B05B 1/3026; B05B 1/3033; B05B 1/304; B05B 1/3046; B05B 1/3066; B05B 1/306
See application file for complete search history.

(56) References Cited

U.S. PATENT DOCUMENTS

2013/0037629 A1* 2/2013 Boquet ..... B05B 1/3013 239/456
2013/0249150 A1* 9/2013 Matsumoto ..... B21B 39/16 266/114

FOREIGN PATENT DOCUMENTS

| | | | |
|---|---|---|---|
| JP | 59-076616 | A | 5/1984 |
| JP | 60-133913 | A | 7/1985 |
| JP | 2006-035233 | A | 2/2006 |
| JP | 2008-264597 | A | 11/2008 |
| WO | WO2012039270 | A1 * | 3/2012 |

* cited by examiner

NOZZLE HEADER, COOLING APPARATUS, MANUFACTURING APPARATUS OF HOT-ROLLED STEEL SHEET, AND METHOD FOR MANUFACTURING HOT-ROLLED STEEL SHEET

TECHNICAL FIELD

The present invention relates to a nozzle header which sprays water to an object, a cooling apparatus provided with the nozzle header, a manufacturing apparatus of a hot-rolled steel sheet, and a method for manufacturing a hot-rolled steel sheet using the nozzle header. The present invention is specifically suitable for spraying water to a high-temperature object such as a hot-rolled steel sheet in contiguity with the object.

Here, the term "nozzle header" means a structure provided with a header which supplies pressurized water and a spray nozzle connected to the header, which sprays the pressurized water supplied from the header.

BACKGROUND ART

As a technique of obtaining an extremely fine grained crystal grain of steel in order to improve the mechanical property of steel material, in manufacturing a hot rolled-steel sheet, a method for rolling a steel sheet at a high rolling reduction at the time of finish rolling and then rapidly cooling the steel sheet just after the finish rolling is suggested. In connection with this, for example as the cooling apparatus disclosed in Patent Document 1, a technical development to establish both a high cooling speed and a uniform cooling (cooling uniformity) has been proceeded (hereinafter, to rapidly cool a steel sheet just after finish rolling is sometimes referred to as "rapidly cool(ing) immediately after finish rolling", and the cooling apparatus for the rapid cooling is sometimes referred to as "apparatus for rapid cooling immediately after (rolling)").

Here, in an actual manufacturing line of a hot-rolled steel sheet, in many cases, a steel sheet in which the crystal grain is extremely fine grained and a general hot-rolled steel sheet (ordinary material) are manufactured in a same line, thus the above-mentioned apparatus for rapid cooling immediately after rolling is not always used. Therefore, an on-off mechanism which switches on and off of spraying is provided to the apparatus for rapid cooling immediately after rolling.

For example in a case where the ordinary material is continuously manufactured for a long time because of conditions of manufacturing schedule of steel sheet, sometimes the apparatus for rapid cooling immediately after rolling is not used for a long time. In this case, because of the radiation heat from a high-temperature steel sheet (800° C. to 900° C.) which comes through a guiding sheet, a deformation originated from heat strain is occurred to the spray nozzle; thus it is concerned that the steel sheet is not uniformly cooled over time. In order to prevent such a heat strain, in a case where the apparatus for rapid cooling immediately after rolling is not used, or the hot-rolled steel sheet is continuously manufactured without using a part of the apparatus for rapid cooling immediately after rolling, it can be considered to cool inside the spray nozzle by spraying water from the spray nozzle for approximately 15 to 20 seconds from the end of the rolling of the preceding steel sheet to the start of the rolling of the following steel sheet.

However, in this case as well, it is not possible to spray pressurized water in rolling, and the spray nozzle is subjected to a large amount of radiation heat from the high-temperature (800° C. to 900° C.) steel sheet, whereby there is a possibility that the deformation of the spray nozzle cannot be inhibited because of repeated cooling and heating.

Also, in a case where the use and disuse of the spray nozzle are switched, an on-off valve can be provided to a water-supply pipe which supplies pressurized water to the spray nozzle. However, if the start/stop of spraying of cooling water is controlled by such an on-off valve, especially at the header on an upper surface side of the steel sheet, the cooling water accumulated to a pipe positioned between the on-off valve and the spray nozzle flows out from the spray nozzle due to gravity, when the spraying of cooling water is stopped. Then, when the on-off valve is opened and the spraying of cooling water is started next time, the spraying of cooling water is not started until the cooling water is filled in a portion from which the water flown out. This causes a problem that the time lag from the order of spraying cooling water to the actual start of the spraying becomes large. This kind of time lag can be a delay or variability of cooling which causes variability in the property of the steel sheet.

From such a viewpoint, it is preferable that the on-off valve is provided to each spray nozzle. According to this, it is possible to dissolve the time lag described above. In this regard, for example an on-off valve described in Patent Document 2 or 3 can be used.

However, radiation heat from the high-temperature (800° C. to 900° C.) steel sheet is irradiated to the spray nozzle via the guiding sheet as described above. Therefore, in a case where the on-off valve is used for the spray nozzle, there is a need to protect each member configuring the on-off valve from the radiation heat. Especially, a member comparatively weak to heat, such as a sealing material, is also provided to the on-off valve; therefore the effect from heat is a problem which occurs not only with time passes, but also in a short period.

CITATION LIST

Patent Literatures

Patent Document 1: Japanese Patent Application Laid-Open No. 2006-035233

Patent Document 2: Japanese Patent Application Laid-Open No. S60-133913

Patent Document 3: Japanese Patent Application Laid-Open No. S59-076616

SUMMARY OF INVENTION

Problems to be Solved by Invention

Accordingly, an object of the present invention is to provide a nozzle header which sprays pressurized water to a high-temperature object, capable of inhibiting a member provided to the spray nozzle from being deformed and damaged from heat caused by the radiation heat from the high-temperature object. The present invention also provides a cooling apparatus and a manufacturing apparatus of a hot-rolled steel sheet that are provided with such a nozzle header, and a method for manufacturing a hot-rolled steel sheet using the nozzle header.

Means for Solving Problems

Hereinafter the present invention will be described. One embodiment of the nozzle header for spraying water to a targeted object can include the nozzle header including a header which supplies pressurized water, one or more of spray nozzles which spray the pressurized water supplied from the header, and a heat removal structure attached in a manner to be in contact with at least one of the spray nozzles, wherein the heat removal structure includes a coolant passage through which a cooling medium for cooling the heat removal structure itself and the spray nozzles passes.

One embodiment of the heat removal structure of the nozzle header may further includes a heat resistant cover which covers the spray nozzles and the coolant passage.

One embodiment of the spray nozzles of the nozzle header may be configured to incorporate an on-off valve which switches start and stop of spraying the pressurized water.

One embodiment of the heat removal structure of the nozzle header may be configured to incorporate a working fluid passage through which a working fluid which operates the on-off valve passes.

One embodiment of the cooling apparatus of the invention may be a steel sheet arranged to a hot rolling line to include a pass line of the steel sheet to spray pressurized water toward the pass line, and/or one embodiment of the nozzle header may be arranged below the pass line of the steel sheet to spray pressurized water toward the pass line.

One embodiment of the manufacturing apparatus of a hot-rolled steel sheet may include a hot finish rolling mill and one embodiment of the cooling apparatus may be arranged on a lower process side of the hot finish rolling mill.

One embodiment of the manufacturing method of a hot-rolled steel sheet may include an end portion on an upper process side of the cooling apparatus arranged inside a housing of the hot finish rolling mill.

One embodiment of the method for manufacturing a hot-rolled steel sheet using a manufacturing apparatus of a hot rolled-steel sheet when the cooling apparatus is not used, or when at least some of the spray nozzles are not used, a cooling medium is passed through the coolant passage of the heat removal structure of the spray nozzles that do not spray the pressurized water.

Effects of Invention

According to the present invention, since the heat removal structure provided with the coolant passage is arranged in contact with the spray nozzle, it is possible to efficiently cool the spray nozzle with the cooling medium. Therefore, it is possible to protect each member configuring the spray nozzle from the radiation heat. This makes it possible to inhibit deformation of the spray nozzle due to heat strain caused by the radiation heat from the targeted object such as a steel sheet, to thereby keep a uniform spraying of the pressurized water.

Also, in a case where a configuration in which the on-off valve is provided to the spray nozzle is employed, the responsiveness of the pressurized water is improved, whereby it is possible to improve the accuracy of spraying timing. In this regard as well, the problem caused by heating of the spray nozzle can be dissolved by the heat removal structure.

DESCRIPTION OF EMBODIMENTS

Figure 1:
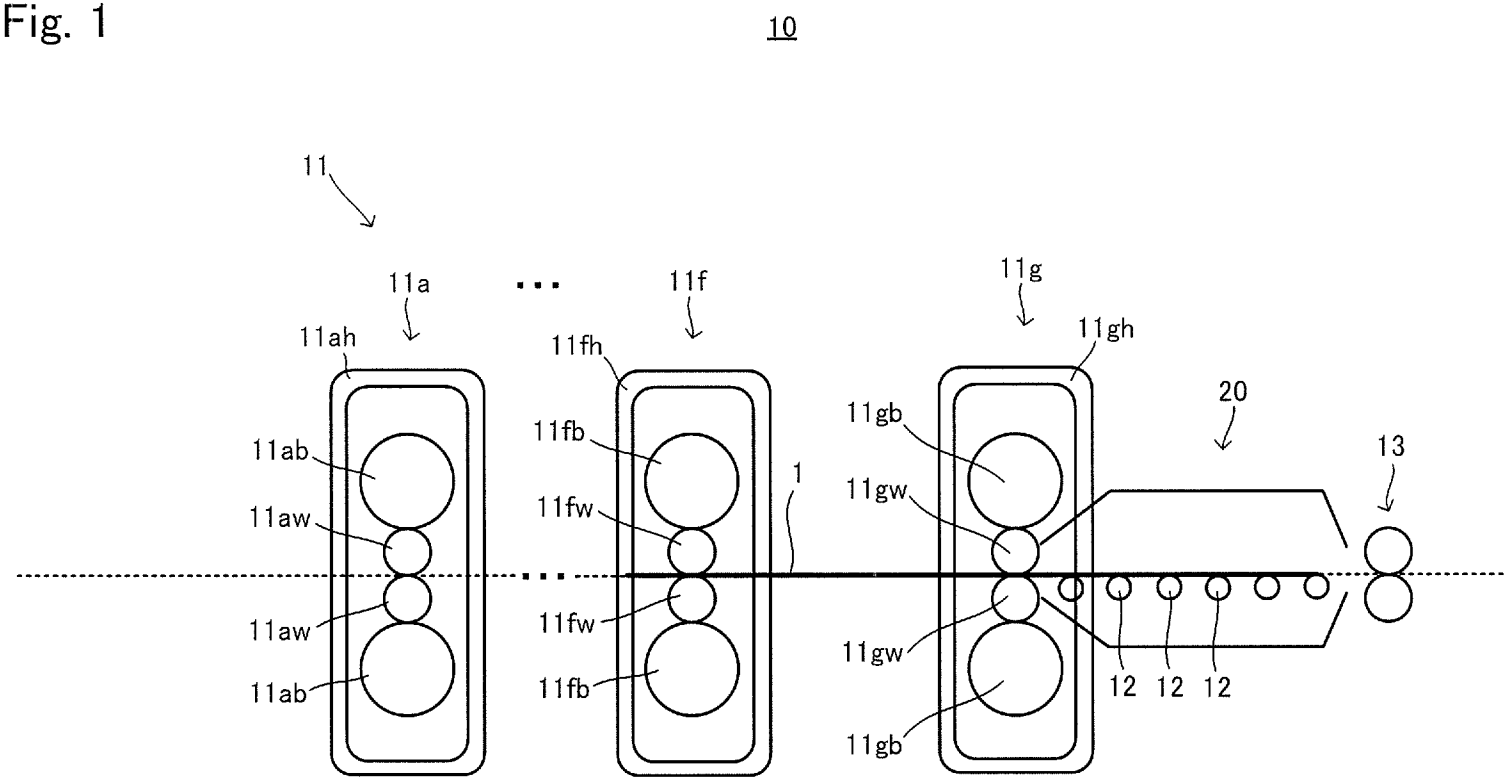
FIG. 1 is a view to explain one embodiment, schematically showing a part of a manufacturing apparatus 10 of a hot-rolled steel sheet.

The above-mentioned functions and benefits of the present invention will be apparent from the modes for carrying out the invention described below. The present invention will be described based on the embodiments shown in the drawings. However, the present invention is not limited to these embodiments.

FIG. 1 is a view to explain one embodiment, schematically showing a part of a manufacturing apparatus 10 of a hot-rolled steel sheet. In FIG. 1, a steel sheet 1 is transported from the left side of the plane of paper (upper process side, upstream side) to the right side of the plane of paper (lower process side, downstream side), and the vertical direction of the plane of paper is a vertical direction of the apparatus 10. A direction from the upper process side (upstream side) to the lower process side (downstream side) is sometimes referred to as a sheet passing direction, and a direction orthogonal to the sheet passing direction and which is a sheet width direction of the steel sheet to be passed is sometimes referred to as a sheet width direction. Also, for the easiness to see, some descriptions of repeated symbols are omitted in the drawings.

As shown in FIG. 1, the manufacturing apparatus 10 of a hot-rolled steel sheet is provided with a row 11 of hot finish rolling mills, a transporting roll 12, a draining roll 13, and a cooling apparatus 20.

Also, a heating furnace, a row of rough rolling mills and the like whose graphic display and explanation are omitted are arranged on the upper process side than the row 11 of hot finish rolling mills, which prepare the conditions of the steel sheet to enter the row 11 of hot finish rolling mills. Also, a thermometer for entering side is provided on an entering side of the row 11 of hot finish rolling mills, to measure the starting temperature of rapid cooling.

On the other hand, on the lower process side of the draining roll 13, a draining spray is arranged for draining the pressurized water sprayed from the cooling apparatus and slightly leaking from a gap between the draining roll 13 and the steel sheet 1. Further, on an exit side of the draining roll 13, a thermometer for exit side is arranged for measuring the stopping temperature of rapid cooling (in a case where the rapid cooling is not carried out, rolling finishing temperature).

A hot-rolled steel sheet is generally manufactured in the following way. That is, a rough bar which has been taken from a heating furnace and has been rolled by a rough rolling mill to have a predetermined thickness is rolled continuously by the row 11 of hot finish rolling mills to a predetermined thickness. After that, depending on the kind of steel material, the steel sheet is cooled in the cooling apparatus 20. Here, in a final stand 11*g* of the row 11 of hot finish rolling mills, the cooling apparatus 20 is arranged inside a housing 11*gh* which supports work rolls 11*gw*, in a manner as close to the work rolls 11*gw* as possible. This makes it possible for the cooling apparatus 20 to function as the apparatus for rapid cooling immediately after rolling.

The steel sheet having passed through the draining roll 13 is cooled by another cooling apparatus to a predetermined coiling temperature to be coiled by a coiler.

Figure 2:
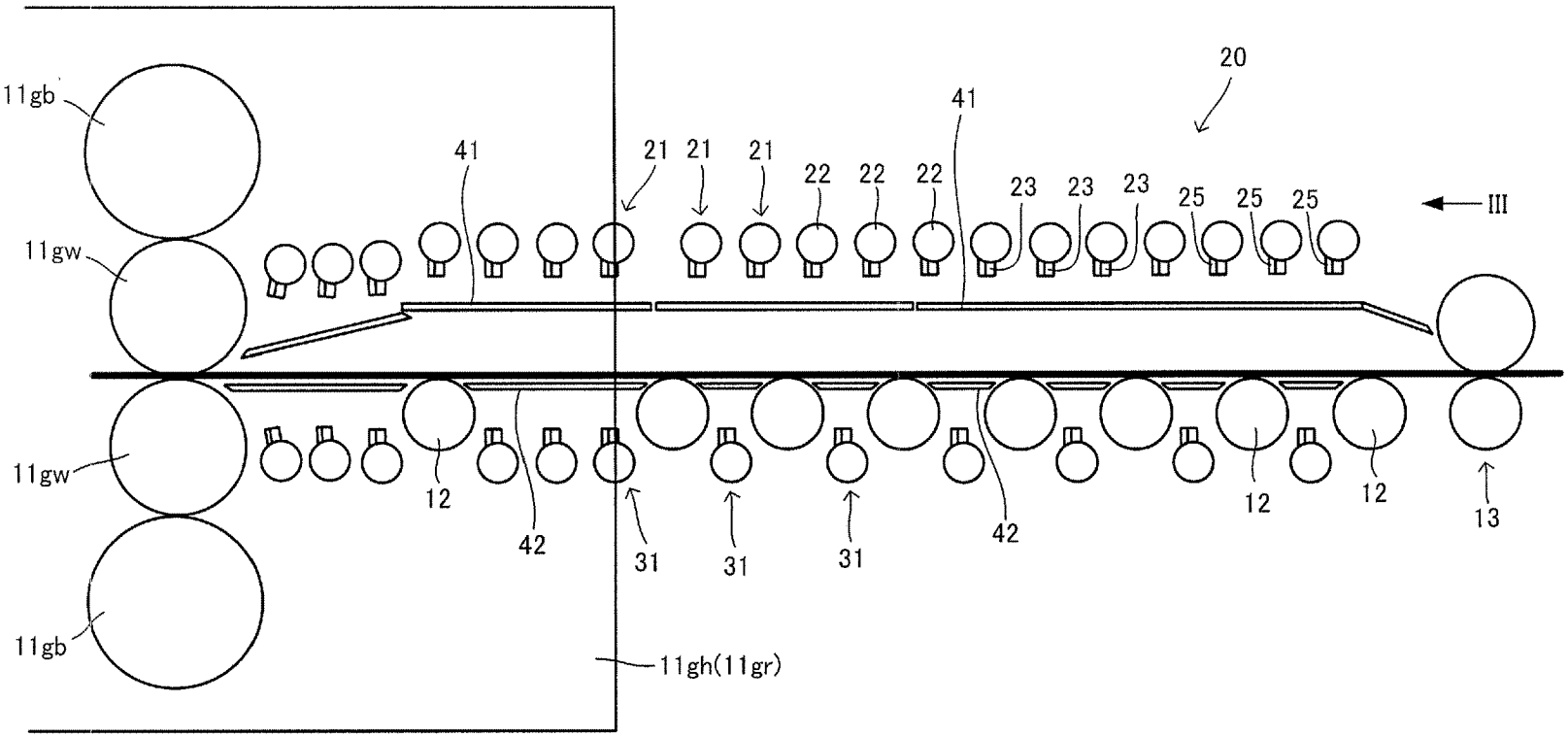
FIG. 2 is an enlarged view of a portion where a cooling apparatus 20 is provided in FIG. 1, to explain the structure of the cooling apparatus 20.
Figure 3:
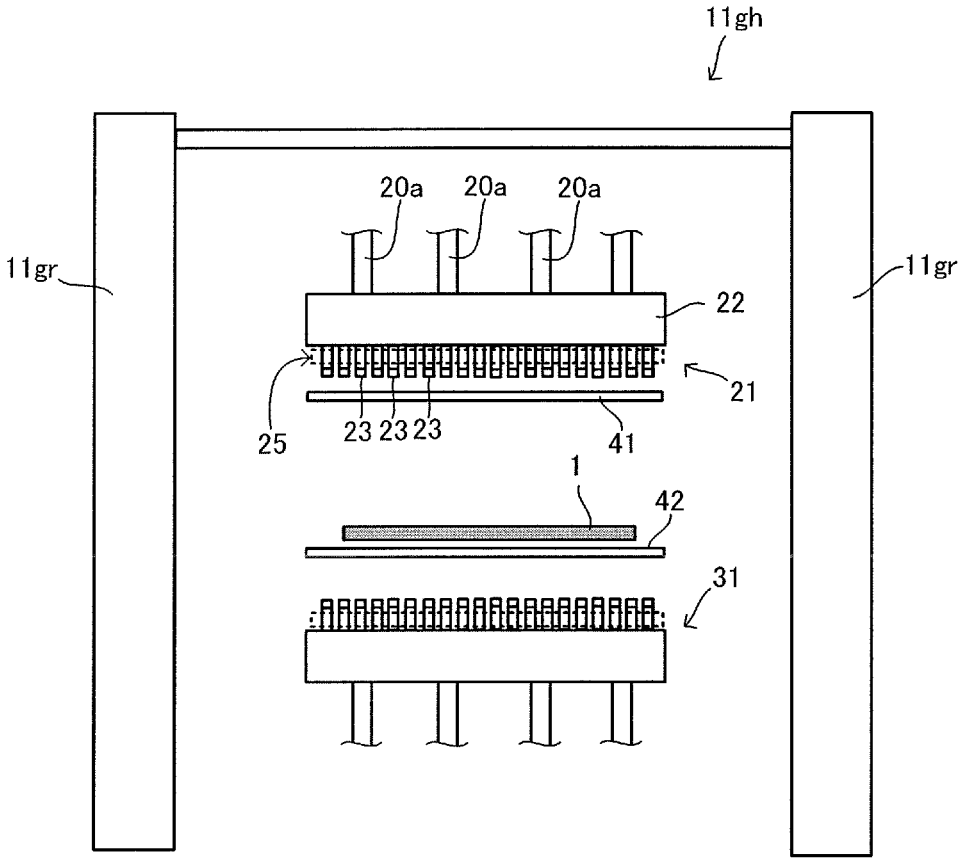
FIG. 3 is a schematic view of the manufacturing apparatus 10 seen from a direction shown by III in FIG. 2.

Hereinafter, the manufacturing apparatus 10 of a hot-rolled steel sheet (hereinafter sometimes simply referred to as "manufacturing apparatus 10") will be specifically described. FIG. 2 is an enlarged view of a portion where the cooling apparatus 20 is provided in FIG. 1, to explain the configuration of the cooling apparatus 20. FIG. 3 is a schematic view of the manufacturing apparatus 10 seen from a direction shown by III in FIG. 2. Therefore, in FIG. 3, the vertical direction of the plane of paper is the vertical direction of the manufacturing apparatus 10, the left and right direction of the plane of paper is the sheet width direction, and the back-to-front direction of the plane of paper is the sheet passing direction.

In the row 11 of hot finish rolling mills in this embodiment, seven stands 11*a*, . . . , 11*f*, 11*g* are arranged in parallel along with the sheet passing direction, as can be seen from FIG. 1. Each stand 11*a*, . . . , 11*f*, 11*g* is provided with a rolling mill, and its rolling conditions such as rolling reduction are set such that the steel sheet to be rolled can satisfy the conditions required for a steel sheet as a final product, such as thickness, mechanical property, and surface quality. Here, the rolling reduction of each stand is set such that the steel sheet to be manufactured satisfies the property which should be satisfied, and it is preferable that the rolling reduction is large at the final stand 11*g*, in view of refining austenite grains and causing accumulation of rolling strain within the steel sheet by carrying out a high rolling reduction, to thereby refine the ferrite grains obtained after rolling.

Rolling mills of the stands 11*a*, . . . , 11*f*, 11*g* respectively have pairs of work rolls 11*aw*, . . . , 11*fw*, 11*gw* that actually pinch and reduce the steel sheet, and pairs of backup rolls 11*ab*, . . . , 11*fb*, 11*gb* arranged such that the outer peripheries thereof are respectively in contact with the outer peripheries of the work rolls. Also, the rotation axis of the work roll and the backup roll is arranged between erected parts of housing 11*ah*, . . . , 11*fh*, 11*gh* erected facing to each other (see an erected parts 11*gr* in FIG. 3 for the final stand 11*g*) provided so as to include the work roll and the backup roll inside the housing. That is, the erected parts of the housing are, as can be seen from FIG. 3, erected in a manner to arrange the line of sheet passing (pass line) of the steel sheet 1 therebetween.

Here, as described below, a part of the end on the upper process side of the cooling apparatus 20 can be arranged close to the work rolls 11*gw* of the final stand 11*g* so as to be inserted inside the housing 11*gh*. This makes it possible to cool the steel sheet 1 immediately after rolling, and the cooling apparatus 20 functions as the apparatus for rapid cooling immediately after rolling.

The transporting roll 12 is a roll which is a table of the steel sheet 1, transporting the steel sheet 1 in the sheet passing direction. Therefore, the transporting roll 12 is arranged in a plural manner having a predetermined gap along the sheet passing direction.

The draining roll 13 is a roll which prevents the pressurized water sprayed from the cooling apparatus 20 from flowing out on the lower process side, by pinching the steel sheet 1 in rolling.

The cooling apparatus 20 is arranged between the row 11 of hot finish rolling mills and the draining roll 13, and can function as the apparatus for rapid cooling immediately after rolling as well. The cooling apparatus 20 is provided with a nozzle header 21 on an upper surface side, a nozzle header 31 on a lower surface side, a guiding sheet 41 on the upper surface side, and a guiding sheet 42 on the lower surface side.

The nozzle header 21 on the upper surface side is a means to supply cooling water to the upper side of the steel sheet 1, and arranged above the pass line. The nozzle header 21 is provided with a header 22, a spray nozzle 23, and a heat removal structure 25.

The header 22 is, as can be seen from FIGS. 2 and 3, a pipe extending in the sheet width direction, and the header 22 is arranged in parallel in a plural manner in the sheet passing direction. Cooling water is supplied from a water-supply pipe 20*a* to the header 22, and the header 22 supplies the cooling water to each spray nozzle 23.

Figure 4:
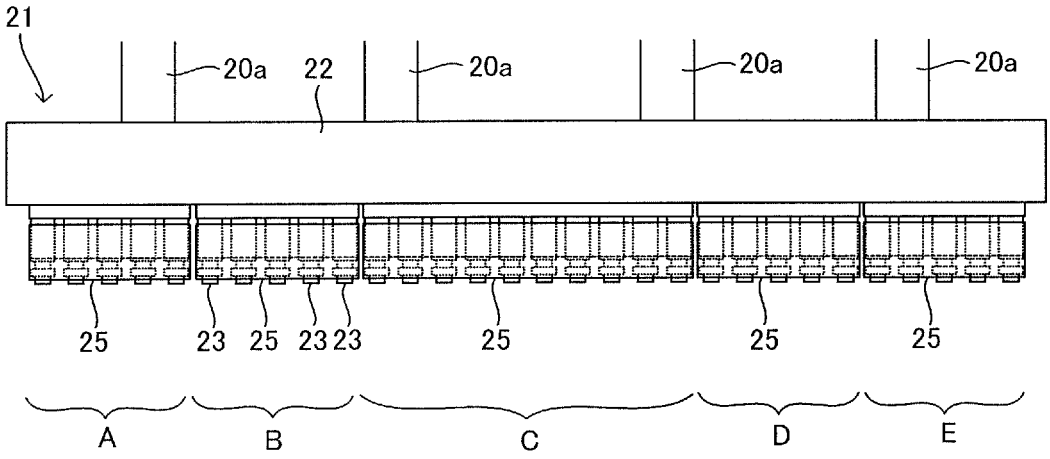
FIG. 4 is a view focusing on a part of a nozzle header 21 in FIG. 3.
Figure 5:
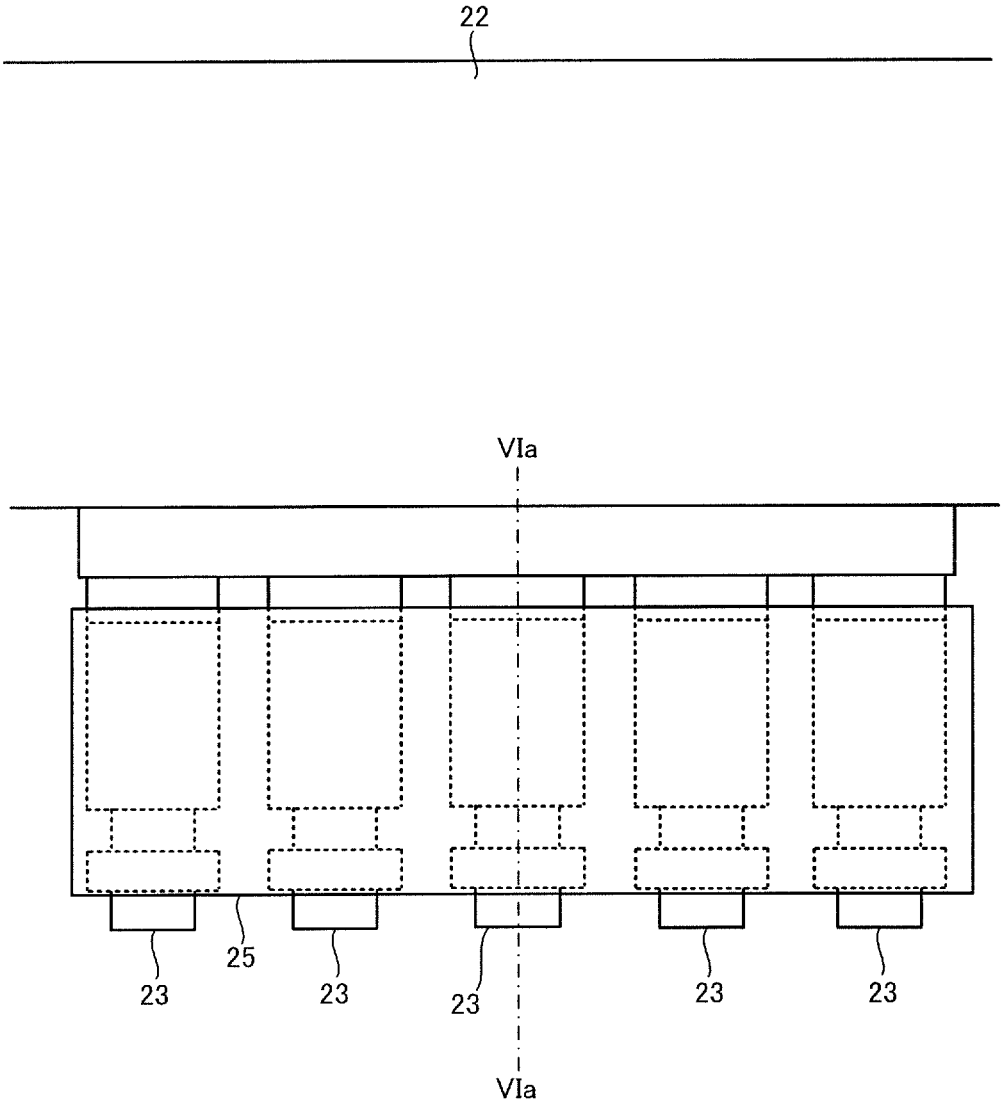
FIG. 5 is an enlarged view of the part of a second controlling region B in FIG. 4.
Figure 6A:
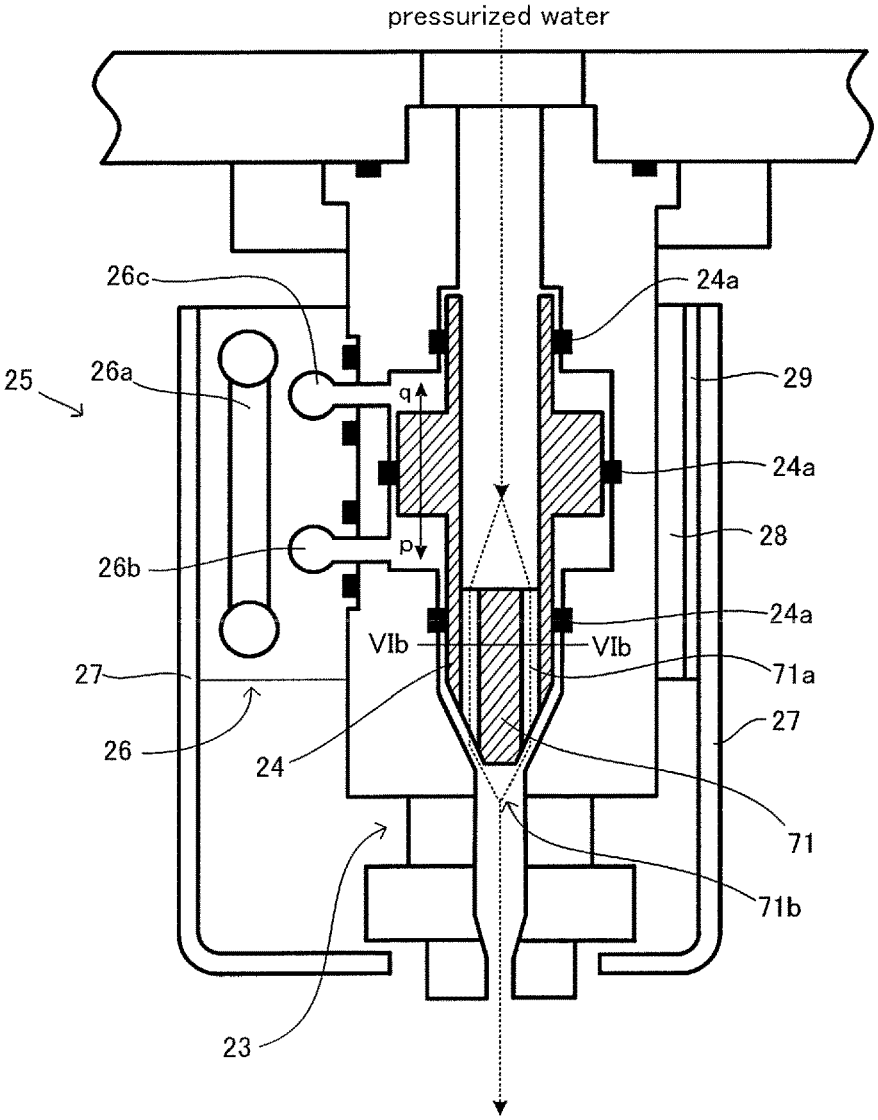
FIG. 6A is a cross-sectional view taken along the line shown by VIa-VIa in FIG. 5.

The spray nozzle 23 is branched off from the header 22 in a plural manner, and its injection port faces the upper surface side of the steel sheet 1 (pass line). FIG. 4 is a view focusing on the nozzle header 21 in FIG. 3. FIG. 5 is an enlarged view of a second controlling region B in FIG. 4. Further, FIG. 6A shows a cross section along the line shown by VIa-VIa in FIG. 5. Therefore, FIG. 6A shows a cross section of the spray nozzle 23 and a cross section of the heat removal structure 25 specifically described later.

The spray nozzle 23 is, as can be seen from FIGS. 3, 4, and 5, arranged in a corm-teeth manner and in a plural manner, along with a pipe length direction of the header 22, that is, in the sheet width direction. The spray nozzle 23 is attached to the header 22 by means of a spray nozzle clamp plate and a spray nozzle clamp bolt (not shown) so as to be removable from the header 22.

The spray nozzle 23 of this embodiment is a flat type spray nozzle which can form a fan-shaped jet of cooling water (for example, having a thickness of around 5 mm to 30 mm). However, the spray nozzle 23 is not limited to this, and a thickening flat spray nozzle, a full-cone spray nozzle and the like can be used as the spray nozzle 23. According to these nozzles, temperature unevenness is difficult to occur in cooling.

Also, as can be seen from FIG. 6A, an on-off valve 24 is arranged inside the spray nozzle 23, as shown by hatching. In this embodiment, the on-off valve 24 is inserted in the passage in the spray nozzle 23, and configured to move inside the passage in the spray nozzle 23, to thereby switch closing and opening of the passage. Specifically, as described later, when the working fluid in a passage 26*b* provided with the heat removal structure 25 is pressurized, the on-off valve 24 moves in a direction shown by the arrow q in FIG. 6A, and opens the passage. On the other hand, when the working fluid in a passage 26*c* provided with the heat removal structure 25 is pressurized, the on-off valve 24 moves in a direction shown by the arrow p in FIG. 6A, and closes the passage.

Figure 6B:
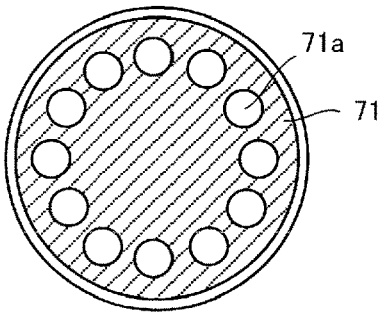
FIG. 6B is a cross-sectional view of a rectifier 71.

Also, in the on-off valve 24, the rectifier 71 is attached on an open end side of the spray nozzle 23. FIG. 6B shows a cross section of the rectifier 71 taken along VIb-VIb in FIG. 6A. As can be seen from FIG. 6B, the rectifier 71 is provided with a plurality of straightening holes 71*a* in a circumferential direction at a cross section of the passage. When the passage of the on-off valve 24 is open, the flow of the pressurized water is straightened by flowing through the straightening holes 71*a*, and its straightening effect is promoted by contracting the flow by a contraction part 71*b* provided to an exit side of the rectifier 71*b*. This makes it possible to largely reduce the variation of the flow of the pressurized water in the spray nozzle 23, to thereby further uniformize the distribution of the flow amount of the jet to be sprayed from the spray nozzle 23.

Here, in order to prevent the pressurized water and the working fluid from leaking, a part of the on-off valve 24 is adhered tightly to an inner wall of the passage of the spray nozzle 23 via a sealing material (e.g. a sealing material 24*a* in FIG. 6). The sealing material is normally configured by a material weak to heat such as a rubber in many cases, in order to improve the sealing property.

In this embodiment, an example in which the on-off valve 24 is provided to the spray nozzle 23 is given. However, the on-off valve does not need to be necessarily provided. However, as described above, it is preferable to provide the on-off valve 24 to each spray nozzle 23, in view of improving the accuracy of the spraying timing of the pressurized water. Also, in this embodiment, the opening and closing of the passage is carried out in the vicinity of injection port of the spray nozzle 23. However, it is also possible to have a configuration in which the opening and closing is carried out on a connection part side with the header (in this case, the passage is closed when the on-off valve moves upward, and opened when the on-off valve moves downward).

Also, in this embodiment, an example in which the operation of the on-off valve is carried out by the working fluid is explained. However, the kind of the on-off valve to be used is not particularly limited, and for example an electromagnetic valve and the like can also be used. However, in view of certainty of the operation in a high-temperature environment, it is preferable to use an on-off valve having a mechanical structure not having any electrical circuit, as in this embodiment.

The heat removal structure 25 is a structure attached on the upper process side and/or the lower process side of the spray nozzle 23, and configured including a cooling member 26 provided with the coolant passage 26A and a heat resistant cover 27.

The cooling member 26 is, as can be seen from FIG. 6A, a block-shaped member provided with the coolant passage 26*a* which is a passage in which the cooling medium flows. The cooling member 26 is arranged such that one surface thereof is in contact with the outer surface of the spray nozzle 23. The flow of the cooling medium is specifically described later.

The cooling medium to pass through the coolant passage 26*a* is not particularly limited, and for example water can be given. By letting the cooling medium pass through the coolant passage 26*a*, firstly the cooling member 26 itself is cooled, and then the spray nozzle 23 is cooled due to thermal conduction via the contact surface with the spray nozzle. Therefore, the cooling member 26 is preferably configured by a material having a high thermal conductivity, and as the material, copper, aluminum, copper alloy, aluminum alloy and the like can be exemplified. Also, in a case where durability is valued, stainless steel and the like also can be used, even though the cooling efficiency is slightly degraded.

The heat resistant cover 27 is a so-called covering member to be arranged in a manner to cover the cooling member 26 and at least a part of a side face to a tip side of the spray nozzle 23. This makes it possible to reduce the radiation heat from the steel sheet 1 and the guiding sheet 41 to the spray nozzle 23 and the cooling member 26, to thereby further inhibit the spray nozzle 23 from being affected by the heat. From this view point, the heat resistant cover is preferably a member having a high intensity and heat resistant property and a low thermal conductivity. Examples of the member can include a stainless steel.

The cooling member 26 and the heat resistant cover 27 are fixated to the spray nozzle 23 by means of a clamp bolt which is not shown, to be arranged as shown in FIG. 6A. In this regard, the cooling member 26 and the heat resistant cover 27 are attached in a manner to sandwich the spray nozzle 23 from the upper process side and the lower process side. At this time, to a surface of the spray nozzle 23 opposite from the side where the cooling member 26 is arranged, a clamp plate 28 and a heat resistant cover 27 are preferably arranged between the heat resistant cover 27 and the spray nozzle 23. The clamp plate 28 is for reinforcing the heat resistant cover 27 so that the heat resistant cover 27 is not deformed when clamped. The heat insulation plate 29 is formed of a material having a high heat insulation property such as the clamp plate 28 and a ceramic board. This makes it possible to further protect each member configuring the spray nozzle 23.

In this embodiment, a passage 26*b* for supplying the working fluid for opening the on-off valve 24 of the spray nozzle 23 and a passage 26*c* for supplying the working fluid for closing the on-off valve 24 are further provided inside the cooling member 26. Therefore, as can be seen from FIG. 6A, the passages 26*b* and 26*c* are arranged so as to overlap with a hole provided to a spray nozzle 23 side in a manner to communicate with the inside of the spray nozzle 23. The working fluid is not particularly limited, and for example a compressed air can be used.

Here, a sealing material (O ring) is embedded to a contact surface between the spray nozzle 23 and the cooling member 26, in a manner to surround the passage of the working fluid, to thereby prevent the working fluid from leaking outside.

Such a heat removal structure 25 can be attached to each spray nozzle 23. However, it is preferable that one heat removal structure 25 is attached to a plurality of spray nozzles 23, as in this embodiment. That is, in this embodiment, as can be seen from FIG. 4, the spray nozzles are divided into a first controlling region A to a fifth controlling region E, and one heat removal structure 25 is provided to each region. Each heat removal structure 25 is arranged such that each of the plurality of spray nozzles 23 is in contact to the heat removal structure 25. For example, five spray nozzles 23 are in contact with the heat removal structure 25 in each region, excepting for a third controlling region C. On the other hand, a lot of spray nozzles 23 are in contact with the heat removal structure 25 in the third controlling region C.

By collectively holding the plurality of spray nozzle 23 with one heat removal structure 25 as described, it is possible to keep the deformation of each spray nozzle 23 in a predetermined direction. Whereby, it is possible to inhibit variation in deformation of each spray nozzle 23 and to hold the degradation of uniform cooling property to the minimum. Also, it can be said that a configuration in which the plurality of spray nozzles 23 are attached to one heat removal structure 25 has an efficient structure, in view of conserving space.

Regarding the nozzle header 21 on the upper surface side described above, as can be seen from FIG. 2, a part of an end on the upper process side is arranged inside the housing 11*gh* of the final stand 11*g* of the row 11 of hot finish rolling mill.

Preferably, the part is made close to the work rolls 11*gw* and arranged at a lower position than other spray nozzles 23, and its jet direction is inclined to a work rolls 11*gw* side from the vertical direction.

With this arrangement, it is possible to rapidly cool the steel sheet 1 immediately after the steel sheet 1 is rolled by the row 11 of hot finish rolling mills.

As can be seen from FIGS. 2 and 3, the nozzle header 31 on the lower surface side is a means of supplying pressurized water to the lower surface side of the steel sheet 1, and arranged below the pass line. The nozzle header 31 on the lower surface side is provided facing the nozzle header 21 on the upper surface side described above, and its jet direction of pressurized water is different from that of the nozzle header 21 on the upper surface side. However, each structure of the nozzle header 31 is same as that of the nozzle header 21 on the upper surface side described above.

It should be noted that, since the transporting roll 12 is arranged below the steel sheet 1, the nozzle header 31 at the lower surface side has a configuration of spraying pressurized water to the lower surface side of the steel sheet 1 from between the transporting roll 12.

The guiding sheet 41 on the upper surface side is a plate-shape member arranged between the pass line where the steel sheet 1 is to be transported and the nozzle header 21 on the upper surface side. The guiding sheet 41 on the upper surface side prevents a tip and other portions of the steel sheet 1 from having contact with or being caught by the nozzle header 21 on the upper surface side. More specifically, the guiding sheet 41 on the upper surface side is arranged having a distance of 100 mm to 150 mm from the pass line at the nearest position to the work rolls 11*gw*, and having an angle with 10° to 20° of incline so as to be positioned gradually higher as reaching to the lower process side. After reaching the height of around 300 mm, the guiding sheet 41 on the upper surface side is kept at an almost constant height until before the draining roll 13.

To the guiding sheet 41 on the upper surface side, a hole to let the pressurized water sprayed from the spray nozzle 23 pass through is provided, and the pressurized water sprayed from the spray nozzle 23 passes through the hole to reach the steel sheet 1. Also, a drain hole to let discharging water pass through can be provided to the guiding sheet 41 on the upper surface side.

The guiding sheet 42 on the lower surface side is a plate-shape member arranged between the nozzle header 31 on the lower surface side and the pass line where the steel sheet 1 is to be transported. This makes it possible to prevent the tip most of the steel sheet 1 from being caught by the nozzle header 31 of the transporting roll 12 especially when the steel sheet 1 passes the manufacturing apparatus 10. More specifically, the guiding sheet 42 is arranged at a position 10 mm to 20 mm lower than the pass line.

Also, an inflow hole to let the jet of the pressurized water from the nozzle header 31 on the lower surface side pass through is arranged to the guiding sheet 42 on the lower surface side. This makes it possible for the jet of the pressurized water from the nozzle header 31 on the lower surface side to pass through the guiding sheet 42 on the lower surface side to reach the lower surface of the steel sheet 1, whereby an efficient cooling is realized. Also, a drain hole to let discharging water pass through can be provided to the guiding sheet 42 on the lower surface side.

Here, the guiding sheet 42 on the lower surface side is arranged between the work rolls 11*gw* and the transporting roll 12, between two of the transporting roll 12, and between the transporting roll 12 and the draining roll 13.

By the configuration of the manufacturing apparatus 10 described above, especially by the configuration of the nozzle headers 21 and 31 of the manufacturing apparatus 10, the heat removal structure 25 provided with the coolant passage 26*a* is arranged in contact with the spray nozzle 23. Therefore, it is possible to efficiently cool the spray nozzle 23 with the cooling medium, to thereby protect each member configuring the spray nozzle 23 from the radiation heat. By providing the heat resistant cover 27, it is possible to further efficiently protect the each member from the radiation heat. This makes it possible to inhibit the spray nozzle 23 from being deformed by heat strain caused by the radiation heat from the steel sheet and the like, to thereby keep a uniform cooling. Accordingly, it becomes possible to continuously cool the spray nozzle 23 in a small space.

Also, by providing the on-off valve 24 to the spray nozzle 23, the responsiveness of pressurized water is improved, whereby it is possible to improve the cooling accuracy. It becomes also possible to dissolve the problem occurred in cooling and caused by heating the spray nozzle 23, by employing the heat removal structure 25. Specifically, by the continuous cooling by the heat removal structure 25, a damage of the sealing material surrounding the on-off valve 24 and the sealing material of a connecting portion of the spray nozzle and the passage of the working fluid can be kept small, and leaking of the pressurized water and the working fluid can be inhibited.

Next, an example of the method for manufacturing a hot-rolled steel sheet using the nozzle headers 21 and 31 will be explained. Here, a case where the nozzle headers 21 and 31, and the manufacturing apparatus 10 provided with the nozzle headers 21 and 31 are used is explained as one example. However, the method is not necessarily limited to this example, and can be carried out with another apparatus.

With the above-mentioned manufacturing apparatus 10, a manufacture of a steel sheet is carried out as a whole for example as follows. That is, a preceding steel sheet 1 is coiled by the coiler, thereafter the rolling of a following steel sheet 1 starts.

The tip of the following steel sheet 1 passes through the row 11 of finish rolling mills, and immediately after the tip of the steel sheet 1 passes the pinch roll, the pinch of the steel sheet 1 starts. This realizes an establishment of a predetermined tension to the steel sheet 1, thereafter the rolling at a constant region starts. The steel sheet 1 successively passes the row 11 of finish rolling mills, to obtain a desirable shape and surface property.

The rolled steel sheet 1 is finally coiled by a coiler.

In this sequence of hot rolling, the cooling apparatus 20 is arranged immediately after the row 11 of hot finish rolling mills, and it sprays the pressurized water from the nozzle headers 21 and 31 to the steel sheet 1, to control the steel sheet 1 to have a desirable temperature. A basic operation of the nozzle headers 21 and 31 is as follows. Here, the explanation is carried out taking the nozzle header 21 as an example.

The spray nozzle 23 sprays the pressurized water as follows. That is, as shown by a dashed line in FIG. 6A, with an open posture of the on-off valve 24, the pressurized water flows from the inside of the pipe of the header 22 to the inside of the spray nozzle 23, and is sprayed from the opening end of the spray nozzle 23 toward the steel sheet 1. On the other hand, with a closed posture of the on-off valve 24 (the posture in which the on-off valve 24 is lowered from the posture in FIG. 6A), the passage of the pressurized water is closed, and spraying of the pressurized water from the spray nozzle 23 is inhibited.

Figure 7:
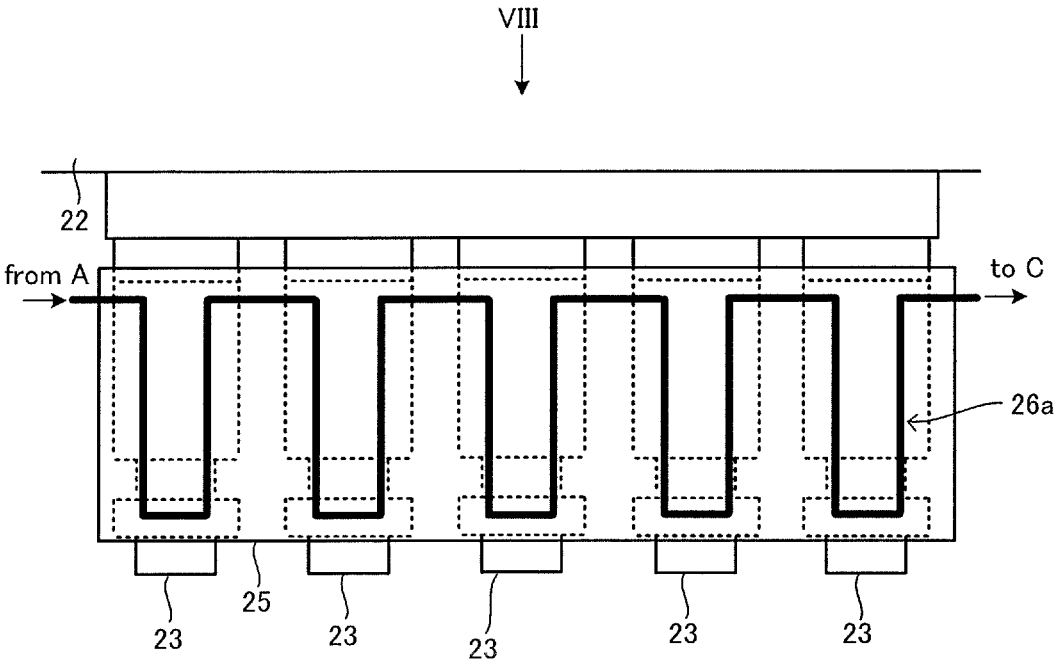
FIG. 7 is a view to explain a flow of the cooling medium.

The cooling of the spray nozzle 23 by means of the cooling member 26 of the heat removal structure 25 is carried out by the cooling medium flowing to the coolant passage 26*a* of the cooling member 26. FIG. 7 is a schematic view of cooling. FIG. 7 is a view having the same point of sight as that of FIG. 5. As can be seen from FIG. 7, the coolant passage 26*a* has a configuration of meandering in a zig-zag manner in the vertical direction and continuing in the sheet width direction. Therefore, the cooling medium flows in the coolant passage 26*a* while depriving the heat of the spray nozzle 23. The cooling medium flows through from the divided first controlling region A to the heat removal structure 25 of the fifth controlling region E for one header 22, whereby it is possible to cool the heat removal structure 25 of entirety of one header 22 as a whole.

The coolant passage 26*a* can increase the heat transfer area subjected to heat transfer, by having a meandering passage in jig-zag manner, whereby it is possible to efficiently cool the spray nozzle 23.

By letting the cooling medium pass through as above, it is possible to inhibit each portion included in the spray nozzle 23 from being deformed or damaged from the heat. The deformation of the spray nozzle 23 due to heat strain caused by the radiation heat from the steel sheet 1 and the like is inhibited, and a uniform cooling can be kept. Also, regarding the on-off valve 24, the damage of the sealing material surrounding the on-off valve 24 and the sealing material of the connecting portion between the spray nozzle and the passage of the working fluid can be kept small, and the pressurized water and the working fluid can be inhibited from leaking.

Figure 8:
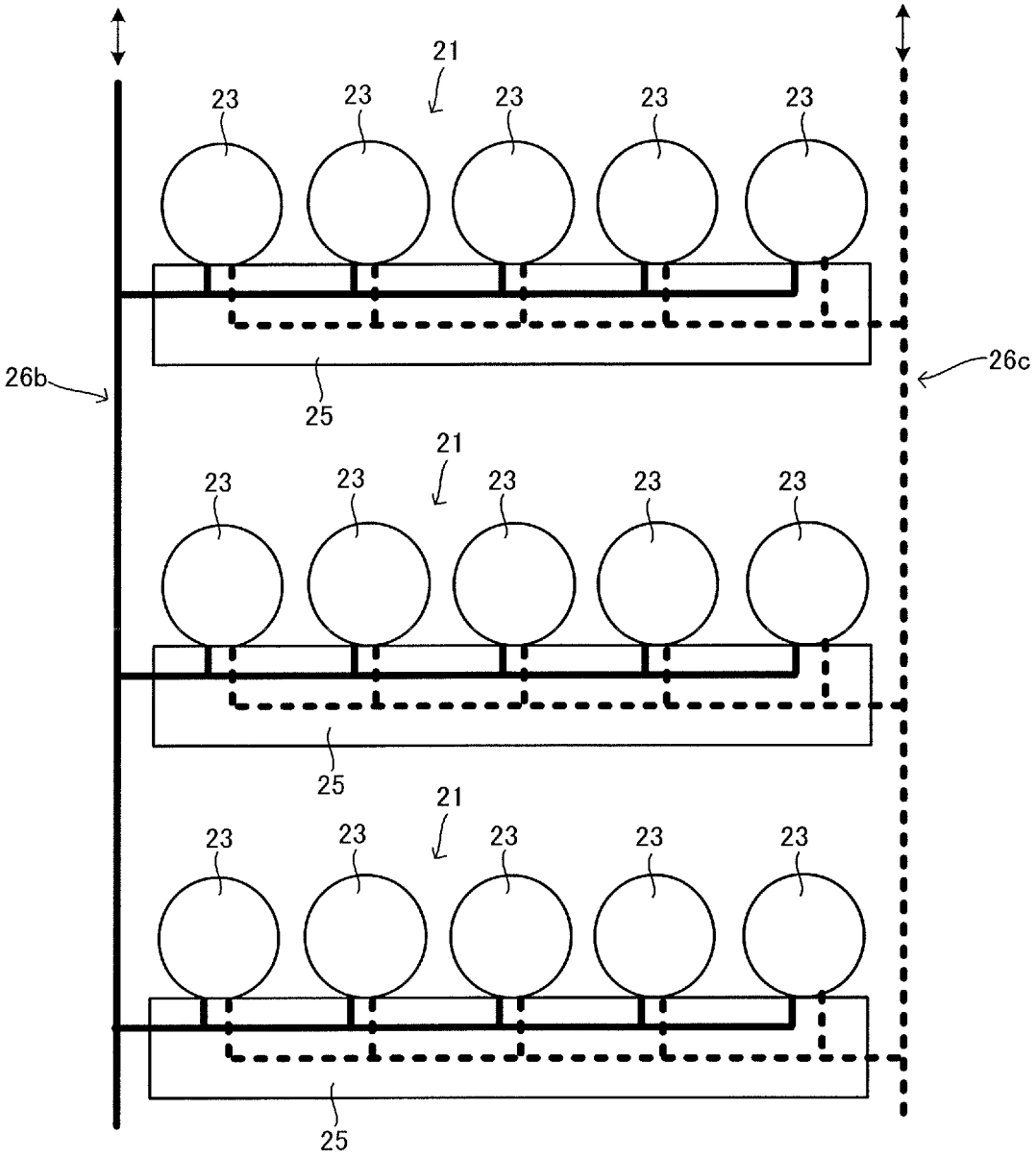
FIG. 8 is a view to explain a flow of the working fluid.

Opening and closing of the on-off valve 24 is carried out by the working fluid flowing through the passages 26*b*, 26*c* of the heat removal structure 25. FIG. 8 is a view for explanation. FIG. 8 is a view seen from a direction of the arrow VIII in FIG. 7. Also, an adjacent nozzle header 21 is shown together in FIG. 8. As can be seen from FIG. 8, regarding the working fluid of the on-off valve 24, supply of each working fluid in each divided controlling region of the heat removal structure 25 can be controlled, and the passage 26*b* for opening the valve and the passage 26*c* for closing the valve are separated in the heat removal structure 25. Therefore, by pressurizing inside the passage 26*b* for opening the valve to push the working fluid in the passage, the on-off valve 24 moves to the direction of the arrow q to have the open posture, as can be seen from FIG. 6A. At this time, the working fluid in the passage 26*c* for closing the valve moves in a manner to be pushed out. It is only necessary to pressurize the passage 26*c* when the on-off valve 24 is to be closed in reverse.

Also, in this embodiment, in a same controlling region between the adjacent nozzle headers 21, 21, the passage of the working fluid is connected to be collectively controlled. This makes it possible to control the start/stop of spraying from the spray nozzle per controlling region divided into five in the sheet width direction, and to collectively control a plurality of nozzle headers. Therefore, for example in a case where a steel material having a narrow width is rapidly cooled, it is possible to stop spraying from the spray nozzles positioned outside in the sheet width direction, to thereby cut down the use amount of the pressurized water (power consumption of pump). The number of the headers collectively controlled can be two, or can be three or more if necessary.

For example in manufacturing a fine grain steel with the nozzle header described above, a rapid cooling is carried out by means of all spray nozzles provided to the cooling apparatus 20. Here, the water amount density of the pressurized water in rapid cooling is preferably 10 $m^3/(m^2 \cdot min)$ or more.

On the other hand, in manufacturing an ordinary material, the cooling apparatus 20 is not used, or it is only necessary to spray the pressurized water only from required nozzle headers, and the spraying with the other spray nozzles are inhibited by closing the on-off valve. In this regard, by letting the cooling medium pass through the heat removal structure 25 for the spray nozzles 23 not being used, the temperature increase of the spray nozzles 23 not being used can be inhibited, to thereby protect the constituent member included in the spray nozzles 23 from the heat.

Figure 9:
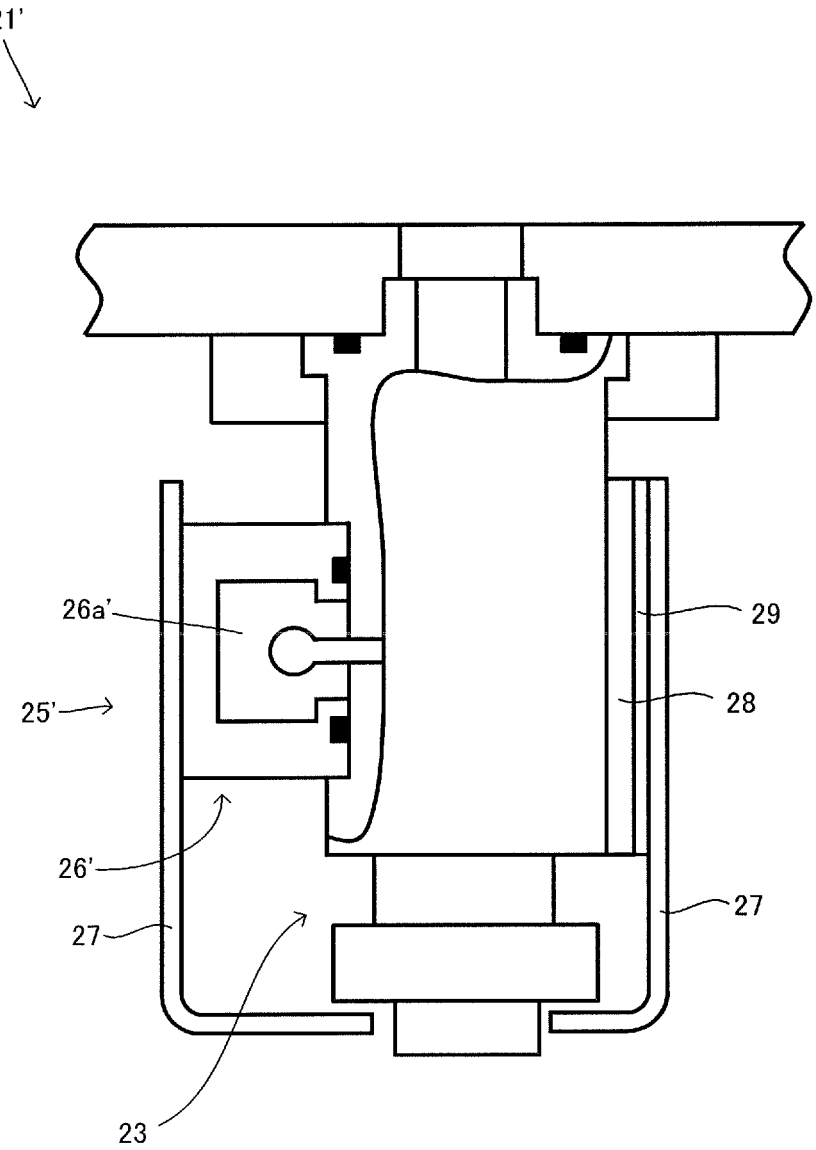
FIG. 9 is a view to explain a nozzle header 21' which is another example.

FIG. 9 is a view showing a nozzle header 21' as another example. FIG. 9 is a view seen from the same point of sight as that of FIG. 6.

The nozzle header 21' of this example is different in having a heat removal structure 25' in place of the heat removal structure 25. In the heat removal structure 25', one wall surface among wall surfaces forming a coolant passage 26*a*' is an outer surface of the spray nozzle 23. With this configuration, since the cooling medium is directly in contact with the outer surface of the spray nozzle 23, it is possible to further efficiently cool the spray nozzle 23.

In the embodiment described above, a configuration in which the heat removal structure is provided to all nozzle headers is taken as an example. However, the embodiment is not necessarily limited to this configuration, and the heat removal structure can be provided for some of the nozzle headers. In this case, it is preferable that the heat removal structure is provided to a portion where is largely affected by the heat from the steel sheet and the guiding sheet when the spraying of the pressurized water is inhibited. As the portion, for example the nozzle header arranged inside the final stand of the finish rolling mills can be given. In addition, a configuration in which the heat removal structure is provided only to the nozzle headers on the upper side, or only to the nozzle heads on the lower side can also be given.

The nozzle header and the cooling apparatus described above are useful for a cooling apparatus of a steel sheet in a manufacturing line of a hot-rolled steel sheet, especially for an apparatus for rapid cooling. In addition to this, an application as/for a descaling apparatus of a hot-rolled steel sheet not intending to cool the steel sheet as a main purpose can be considered.

EXAMPLES

Example 1

In Example 1, a calculation was carried out by a simulation regarding inhibition of the deformation of the spray nozzle due to thermal expansion, when the heat removal structure 25 was used as an example of the present invention. The calculation was carried out for a model of the nozzle header in which 21 of the spray nozzles in total were collectively held by one heat removal structure. Regarding the model of the nozzle header, a deformation amount caused to the spray nozzle due to thermal expansion in a case where the inside of the heat removal structure was cooled (assuming a case where a cooling water passed through the coolant passage and the temperature of the heat removal structure (cooling member) was 80° C.) was calculated. Also, as Comparative Example, a deformation amount of a model deformed due to thermal expansion in which the heat removal structure was not attached (assuming the temperature of the heat removal structure (cooling material) as 200° C.) was also calculated.

Figure 10:
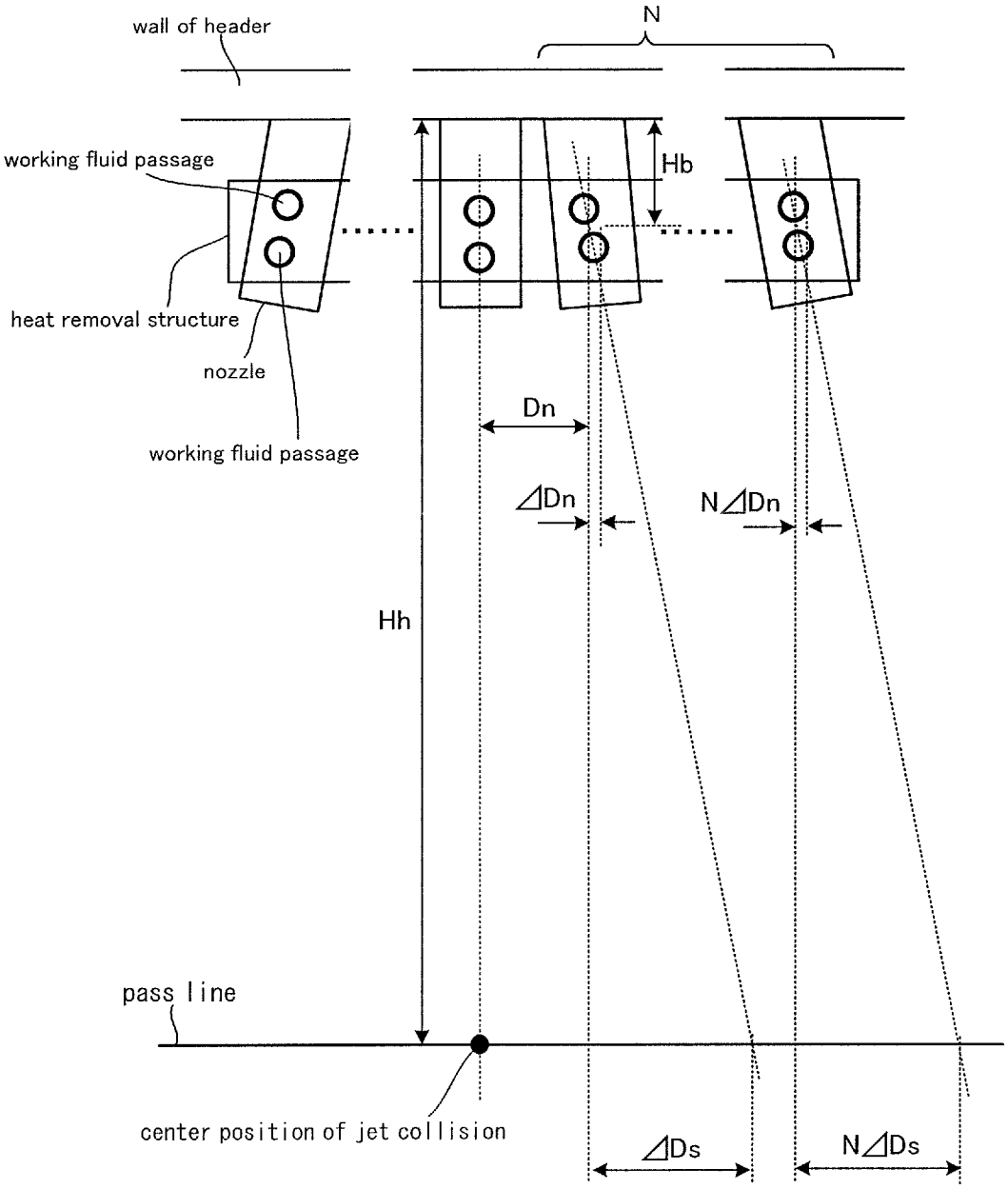
FIG. 10 is a view to explain conditions of Example 1.

The temperature of the header was assumed as kept stably at 40° C., due to the released heat via the water-supply pipe and the pressurized water accumulated inside the header. The preconditions of the calculation and the calculation results are together shown in FIG. 10 and Table 1.

TABLE 1

| | | Example | Comparative Example |
|---|---|---|---|
| Conditions | Linear expansion coefficient (SUS) of heat removal structure | 1.8E−05/° C. | 1.8E−05/° C. |
| | Pitch of nozzle | 60 mm | 60 mm |
| | Temperature of header | 40° C. | 40° C. |
| | Temperature of removal structure | 80° C. | 200° C. |
| | Distance Hb between header and heat removal structure | 125 mm | 125 mm |
| | Distance Hh between header and pass line | 550 mm | 550 mm |
| | Number N of spray nozzles on one side of heat removal structure | 10 | 10 |
| Calculation result | Change amount ⊿Dn of pitch of nozzle at heat removal structure | 0.04 mm | 0.17 mm |
| | Change amount N⊿Dn of position of nozzle at end most part of heat removal structure | 0.43 mm | 1.73 mm |
| | Change amount ⊿Ds of pitch of center position of jet collision | 0.19 mm | 0.76 mm |
| | Change amount N⊿Ds of center position of get collision of nozzle at end most part of heat removal structure | 1.90 mm | 7.60 mm |

As can be seen from Table 1, when the spray nozzles were overheated to 200° C., the gap between the spray nozzle at the center of the heat removal structure and the spray nozzle at the end most part of the heat removal structure was widen by 1.73 mm, compared in a case where there is no thermal expansion. In contrast, in a case where the inside of the spray nozzles was cooled, widening amount of the gap between the spray nozzle at the center of the heat removal structure and the spray nozzle at the end most part was kept low to be 0.43 mm.

Further, since the header with which the base of the spray nozzle was fixated does not expand with heat, the spray nozzle inclined in a manner to stretch outside in the sheet width direction. Therefore, the gap at the center position of jet collision on the pass line was widened as 7.60 mm when the internal cooling was not carried out. In contrast, by carrying out the internal cooling, the widening amount could be kept as 1.90 mm.

Example 2

Figure 11:
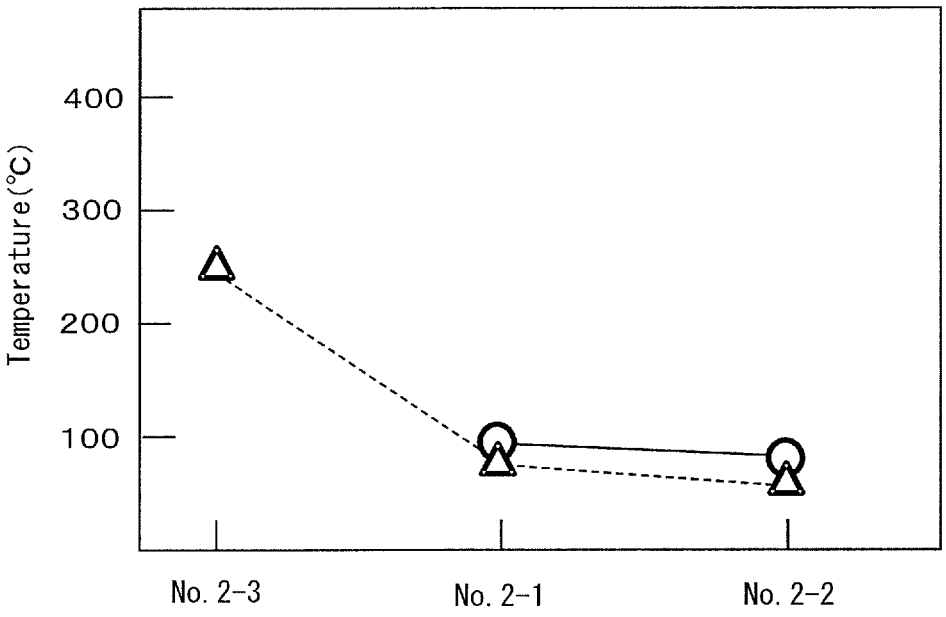
FIG. 11 is a graph to show the result of Example 2.

In Example 2, an ordinary material was continuously rolled with the manufacturing apparatus shown in FIGS. 1 to 5. That is, in Example 2, the cooling apparatus 20 was not used. However, the spray nozzle was cooled by spraying of the pressurized water for approximately 10 seconds, from the end of the rolling of a preceding steel sheet to the start of the rolling of a following steel sheet. At this time, the temperature of the spray nozzle attached to the guiding sheet on the upper surface side at the nearest position of the work rolls (the portion arranged inside the housing of the finish rolling mill) was measured. The conditions are shown in Table 2 and the results are shown in FIG. 11. In Table 2, No. 2-2 has a structure shown in FIGS. 6A and 6B, No. 2-1 has a structure in which the heat resistant cover 27 is removed from the structure of the No. 2-2, and No. 2-3 has a structure in which the whole heat removal structure was removed from the structure of No. 2-2. In FIG. 11, the opened circle shows the temperature inside the heat resistant structure and the opened triangle shows the temperature inside the spray nozzle.

TABLE 2

| | Conditions | Notes |
|---|---|---|
| No. 2-1 | Provided with heat removal structure (except for heat resistant cover) | Example |
| No. 2-2 | Provided with heat removal structure (heat resistant cover is also provided) | Example |
| No. 2-3 | Not provided with heat removal structure | Comparative Example |

In a case where Comparative Example of No. 2-3 (conventional example) was used, the temperature inside the spray nozzle reached to approximately 250° C., and the sealing material in the on-off valve was cured by the heat and lost its original elasticity only after several days of use, whereby water leak started to occur even when the on-off valve was closed. Also, the sealing material at the attachment portion of the pipe for the working fluid to the spray nozzle was also deteriorated, whereby leaking of the working fluid (air) was frequently occurred.

On the other hand, in the example of No. 2-1, the temperature of both inside the spray nozzle and inside the heat removal structure was kept as 100° C. or less. In fact, occurrence of the leaking at the all connecting portions of the on-off valve of the spray nozzle and the working fluid passage was not found out, even at a check up after three-month use. In the nozzle header in which a heat insulation plate was attached inside the heat resistant cover as No. 2-2, it was confirmed that it was possible to further decrease the temperature by 10° C. to 20° C.

Example 3

In Example 3, the nozzle headers of No. 2-2 and No. 2-3 of Example 2 were used to examine the transition as time passes of a steel sheet temperature deviation when a hot-rolled steel sheet was rapidly cooled immediately after rolling, with the conditions of the rapid cooling immediately after rolling. Here, the "steel sheet temperature deviation" is a standard variation of the center portion of the temperature distribution, from which an inconstant part cooled without subjected to the tension at the top end and the bottom end, and the area of 50 mm from the both end portions in the width direction are eliminated. The temperature distribution was in a width direction on the upper surface of the steel sheet after stopping rapid cooling, measured by a thermometer capable of measuring the temperature distribution in the sheet width direction provided to the backward of the draining roll 13. The standard variation is calculated as an average value of all steel sheets to which the rapid cooling immediately after rolling was applied for approximately one month from the start of data collection of each time period.

Figure 12:
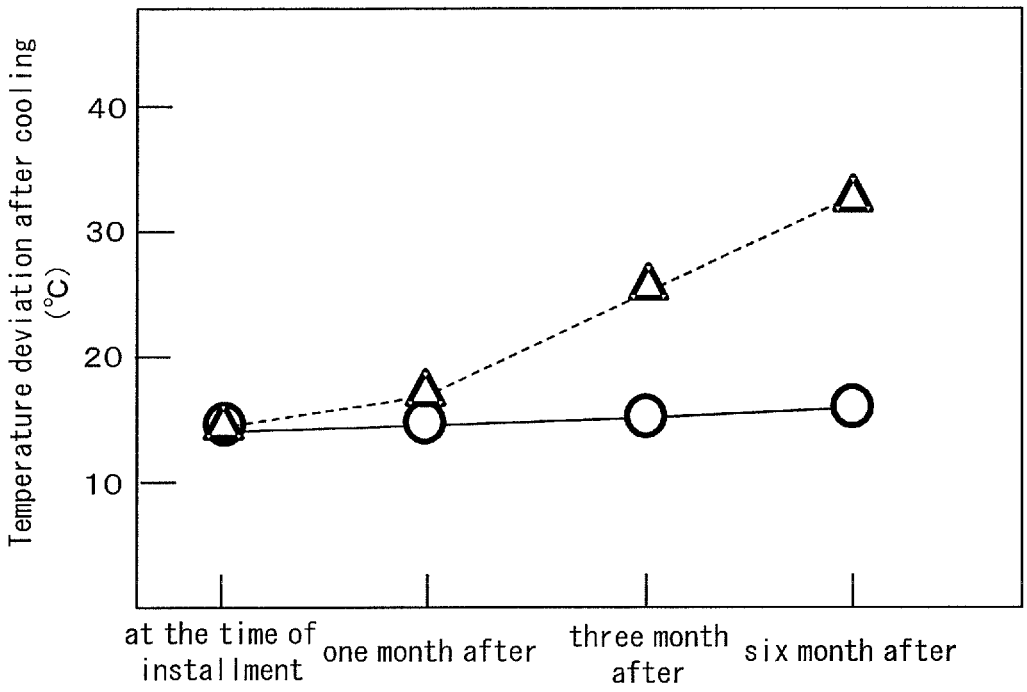
FIG. 12 is a graph to show the result of Example 3.

It should be noted that, in the examination period, not only the steel material by the rapid cooling immediately after rolling was manufactured, but the time period of continuous rolling the ordinal material (the cooling of the spray nozzles in this case is same as that of Example 2) was also frequently included. The examination results are shown in FIG. 12. In FIG. 12, the opened triangle shows the result of the example of No. 2-3 (Comparative Example), and the opened circle shows the result of the example of No. 2-2 (Example of the present invention).

As can be seen from FIG. 12, in a case where the nozzle header of No. 2-2 was used, its cooling uniformity almost never became worse even after six month has passed. It can be considered that this is because, as shown in Example 2, the temperature of the spray nozzle and the heat removal structure is always kept as 100° C. or less, whereby the plastic deformation due to heat strain was hardly occurred.

In contrast, in a case where the nozzle header of No. 2-3 was used, the steel sheet temperature deviation was changed from an initial setting state to be increased. It is considered that this is originated from the variation in the attachment angle of the spray nozzle due to plastic deformation of the header and the spray nozzle, by repeated heating from the radiation heat from the steel sheet and the guiding sheet and repeated cooling by the spraying from the spray nozzle, with the time period of use passes. In addition to this, in the example of No. 2-3, the sealing materials at the attachment portion of the working fluid pipe and the on-off valve were damaged by the radiation heat, whereby leaking of the working fluid and water leak from the on-off valve were frequently occurred. In each occasion, the sealing material was changed to deal with the leaking. However, since the nozzle header basically had a structure in which a lot of pipes are arranged in a narrow space, it took a long time to change the sealing material at the attachment portion of the working fluid pipe, whereby the production amount of the steel sheet was degraded due to decrease in the working time of the rolling mill.

DESCRIPTION OF THE REFERENCE NUMERALS

1 steel sheet
10 manufacturing apparatus
11 row of finish rolling mills
12 transporting roll
13 draining roll
20 cooling apparatus
21 nozzle header on upper surface side
22 header
23 spray nozzle
24 on-off valve
25 heat removal structure
31 nozzle header on lower surface side

The invention claimed is:

1. A nozzle header for spraying water to a targeted object, comprising:

a header which supplies pressurized water;

a plurality of spray nozzles which spray the pressurized water supplied from the header; and a heat removal structure collectively holding the plurality of spray nozzles, each spray nozzle being in contact with the heat removal structure, wherein the heat removal structure comprises a coolant passage through which a cooling medium for cooling the removal structure itself and the spray nozzles passes, and at least one of the spray nozzles incorporates an on-off valve which moves inside a passage in the spray nozzle, to switch between starting and stopping the spraying of the pressurized water, wherein the on-off valve has a part at a portion which opens and closes the passage, the part tapering and narrowing from the valve towards the exit side of the spray nozzle, wherein the heat removal structure incorporates two working fluid passages separated from each other and arranged so as to communicate with an inside of each spray nozzle, the on-off valve moves towards an opened direction by an appliance of pressure from a working fluid that passes through inside one of the working fluid passages, and the on-off valve moves towards a closed direction by an appliance of pressure from a working fluid that passes through inside the other one of the working fluid passages.

2. A cooling apparatus of a steel sheet comprising a plurality of the nozzle headers according to claim 1.

3. The cooling apparatus according to claim 2, wherein the plurality of spray nozzles are arranged in a sheet width direction of a steel sheet and the coolant passage continues in the sheet width direction.

4. A manufacturing apparatus of a hot-rolled steel sheet, comprising:

a hot finish rolling mill; and the cooling apparatus according to claim 2 arranged on a lower process side of the hot finish rolling mill.

5. The manufacturing apparatus of a hot-rolled steel sheet according to claim 4, wherein an end portion on an upper process side of the cooling apparatus is arranged inside a housing of the hot finish rolling mill.

6. A method for manufacturing a hot-rolled steel sheet using the manufacturing apparatus of a hot-rolled steel sheet according to claim 4, a step of starting the spraying of the pressurized water from the plurality of the spray nozzles, a step of stopping the spraying of the pressurized water from at least a part of the plurality of the spray nozzles, and a step of flowing the cooling medium to the heat removal structure of the plurality of the spray nozzles which have stopped the spraying of the pressurized water.

* * * * *